United States Patent [19]

Martell

[11] Patent Number: 5,004,157

[45] Date of Patent: Apr. 2, 1991

[54] SPRINKLER SYSTEM

[76] Inventor: Ely A. Martell, 60 Grandview Dr., So. Yarmough, Mass. 02341

[21] Appl. No.: 402,518

[22] Filed: Sep. 5, 1989

[51] Int. Cl.[5] ..... B05B 15/10

[52] U.S. Cl. ..... 239/205; 239/DIG. 1

[58] Field of Search ..... 239/200–206, 239/DIG. 1

[56] References Cited

U.S. PATENT DOCUMENTS

| | | | |
|---|---|---|---|
| 1,751,723 | 3/1930 | Borgeson | 239/205 |
| 1,853,805 | 4/1932 | Elder | 239/205 |
| 3,454,225 | 7/1969 | Hunter | 239/205 |
| 3,921,910 | 11/1975 | Hayes et al. | 239/205 |
| 4,003,520 | 1/1977 | Bailey | 239/205 |
| 4,078,726 | 3/1978 | Walto | 239/205 |
| 4,796,809 | 1/1989 | Hunter | 239/205 |

FOREIGN PATENT DOCUMENTS

| | | | |
|---|---|---|---|
| 527814 | 4/1930 | Fed. Rep. of Germany | 239/205 |

*Primary Examiner*—Andres Kashnikow

*Assistant Examiner*—Michael J. Forman

*Attorney, Agent, or Firm*—John P. McGonagle

[57] ABSTRACT

An improved underground sprinkler system having double action pop-up nozzles. The system has a plurality of removable sprinkler nozzle assemblies each having a longitudinally externally slotted generally cylindrical body residing in a cylindrical filter having a keyway for receipt in the slot, an externally and internally slotted cylindrical extendable sprinkler head that receives the nozzle/filter assembly, and an internally keyed cylindrical base mount that receives the nozzle/-filter/ head assembly. In the specific arrangement of the invention fluid pressure entering a bottom passage of the base mount pushes the sprinkler head upward against the bias of a spring attached to the base mount and the sprinkler head, and then the nozzle assembly in the sprinkler head upward against the bias of a second spring attached to the nozzle assembly and the sprinkler head. The key and slot arrangement automatically rests the nozzle and filter after cleaining.

6 Claims, 5 Drawing Sheets

SPRINKLER SYSTEM

BACKGROUND OF THE INVENTION

This invention relates to garden and lawn sprinkler systems, and more particularly to an improved underground sprinkler system having pop-up nozzles.

Underground sprinkler systems have long been utilized to provide irrigation water to lawns, gardens and shrubbery. The primary advantage of such sprinkler systems is their lack of visibility when the system is not operating since the pipes interconnecting the sprinkler nozzles are concealed underground and the sprinkler nozzles themselves are generally positioned flush with the surface of the ground. The nozzles utilized with underground sprinkler systems generally rise above the surface of the ground when the sprinkler is operating and return to their flush position when water flow is terminated.

Conventional underground sprinkler systems generally exhibit a number of problems. The sprinkler heads are usually fabricated from a large number of parts which must be assembled thereby making the nozzles somewhat expensive since the manufacturing and assembling costs are quite high. The large number of parts make the sprinkler heads susceptible to breakdown increasing the amount of maintenance required for underground sprinkler systems. Most underground sprinkler systems are difficult to partially disassemble when repairing a malfunctioning sprinkler head. Another serious disadvantage of underground sprinkler systems, which is compounded by the first, is that underground sprinklers tend to become clogged from grit, sand, debris, insects and insect eggs. Still another drawback to conventional underground sprinkler systems, is the large amounts of water such systems tend to use.

SUMMARY OF THE INVENTION

The sprinkler system of the present invention has multiple sprinkler heads each having preset spray patterns for distributing water uniformly and efficiently thereby minimizing the number of sprinkler heads used. The sprinkler heads have few parts, can be readily cleaned by homeowners, and are easily removed from the sprinkler system and returned to their original settings, such that the spray pattern need never be reset. The sprinkler head and its spray nozzle are normally in a retracted position. They are hydraulically and independently raised by water pressure to an optimal sprinkling position thereby greatly reducing the chances of the system becoming clogged from dirt and grit. The spray nozzle has small orifices for reduced water consumption and has close tolerances to eliminate spacing between cooperating components of the system which otherwise could catch sand, grit, debris, or provide a recess to receive insects or insect eggs and become clogged, either partially or fully. In the retracted or closed position the spray nozzle is tightly seated in the sprinkler head and the sprinkler head is tightly enclosed in a housing thereby reducing exposure to damage or dirt or other contaminants which could clog the sprinkler head and/or spray nozzle so that the spray pattern is distorted or reduced.

Accordingly, it is a primary objective of the present invention to provide an underground sprinkler system having fixed spray patterns oriented to individual base mounts, having spray patterns protected by filtration to prevent clogging and malfunction, having ease of disassembly and assembly for cleaning without special tools, and requiring less water consumption due to spray control means which operates to produce finer and wider spray over a wide range of water pressures.

It is a further object of the present invention to provide a sprinkler system with spray nozzle and sprinkler head so positioned in a retracted, non-sprinkling position, that chances of clogging are greatly reduced.

It is still another object of the present invention to have the sprinkler head and its spray nozzle independently responsive to hydraulic water pressure to further reduce chances of clogging.

Other and further objects, as well as various advantages and features of novelty which characterize the invention are pointed out with particularity in the claims annexed hereto and forming a part hereof. However, for a better understanding of the invention, its objectives and advantages obtained by its use, reference should be had to the drawings which form a further part hereof, and to the accompanying descriptive matter in which there is illustrated and described a preferred embodiment of the invention.

BRIEF DESCRIPTION OF THE DRAWINGS

FIG. 2D is a perspective of the plug thereof;

DETAILED DESCRIPTION OF THE INVENTION

Figure 1C:
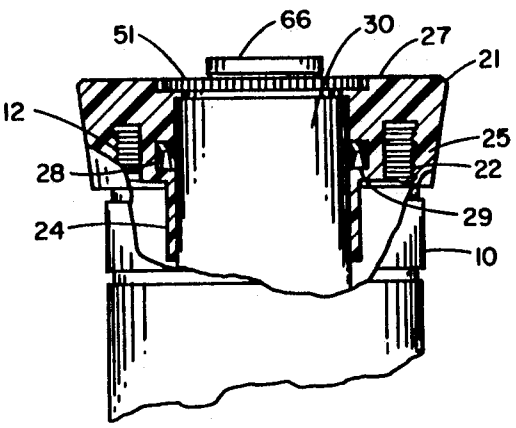
FIG. 1C is a cross-sectional view of the outer cap of FIG. 1A.
Figure 1B:
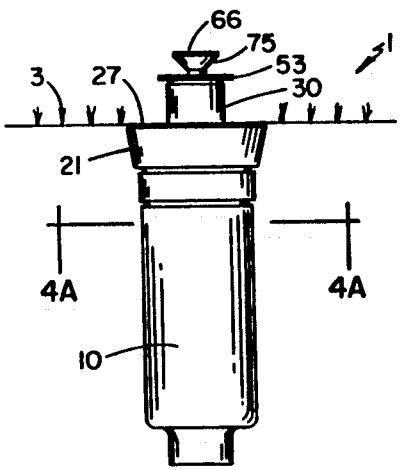
FIG. 1B is a side view of the present invention in its extended position.
Figure 1A:
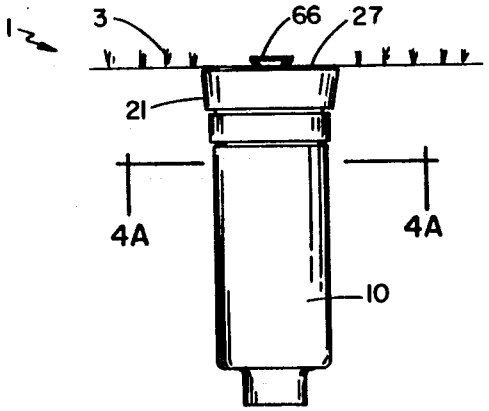
FIG. 1A is a side view of the present invention in its retracted position.

Referring to the drawings in detail wherein like numerals indicate like elements there is shown a sprinkler system according to the present invention having three types of sprinkler units, generally designated by the reference numeral 1, within the system. Unit A is used for directing a water spray in a 360 degree arc; unit B is used for directing a water spray in a 180 degree arc; and unit C is used for directing a water spray in a 90 degree arc. Each sprinkler has a commonalty of parts and for purposes of exposition, Unit A will be described in detail first and then units B and C will be described in terms of their differences from unit A. Each sprinkler unit A, B and C has two basic positions, i.e., retracted (FIG. 1A) or extended (FIG. 1B).

Sprinkler unit A which outwardly directs a water spray in a 360 degree arc includes a base mount 10 having a substantially cylindrical shape and which may be constructed from any suitable material, such as metal or plastic; and a sprinkle head assembly 20 mounted for movement relative to the base mount 10. The upper end 11 of the base mount 10 is opened and is provided with external threads 12 which are adapted to receive an outer cap 21. The base mount 10 also includes a bottom wall 13 having an inlet 14 at the bottom end 15 thereof for receiving water under pressure into the base mount 10 from an underground supply of water (not shown). The inlet 14 is provided with any suitable means, such as internal threads 16 for connection of the base mount 10 to an underground water supply. The base mount 10 is internally formed into a cylindrical well having four equispaced longitudinal lands, three 17 narrow and one 18 relatively wider.

Figures 2A, 2B, 2C:
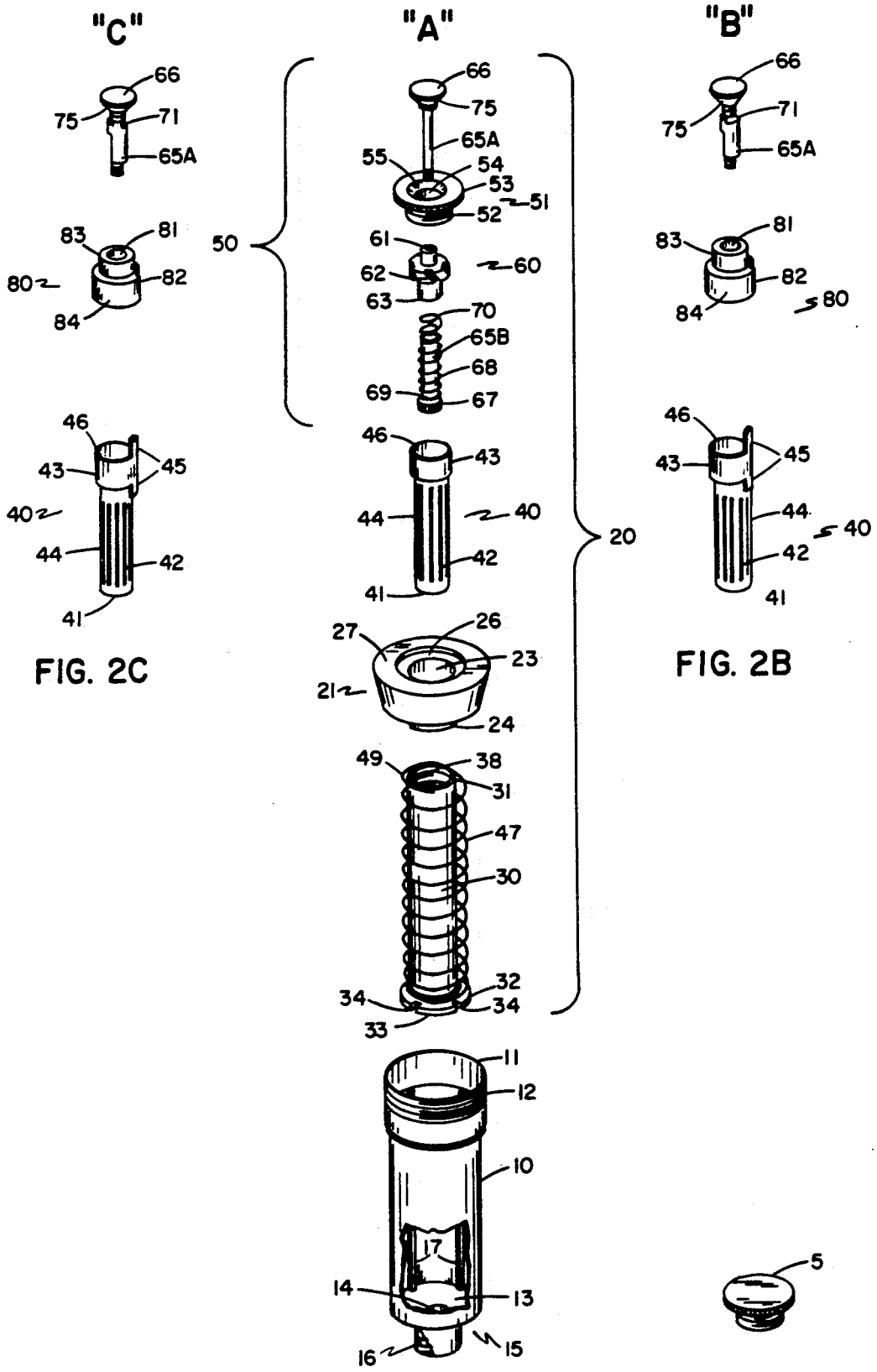
FIG. 2A is an exploded perspective view of Unit A sprinkler unit thereof.
FIG. 2B is an exploded perspective view of a portion of a Unit B sprinkler unit thereof.
FIG. 2C is an exploded perspective view of a portion of Unit C sprinkler unit thereof.
Figure 3A:
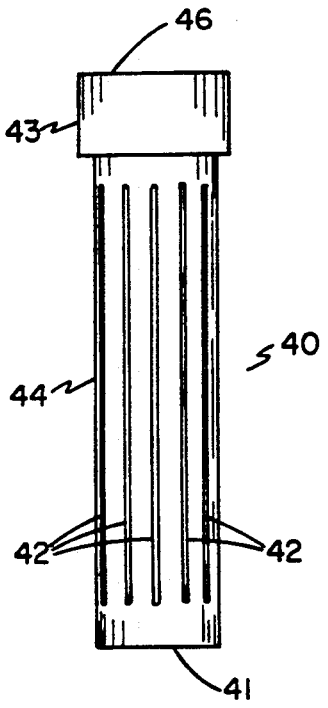
FIG. 3A is a side view of the Unit A main shaft filter unit.
Figure 3B:
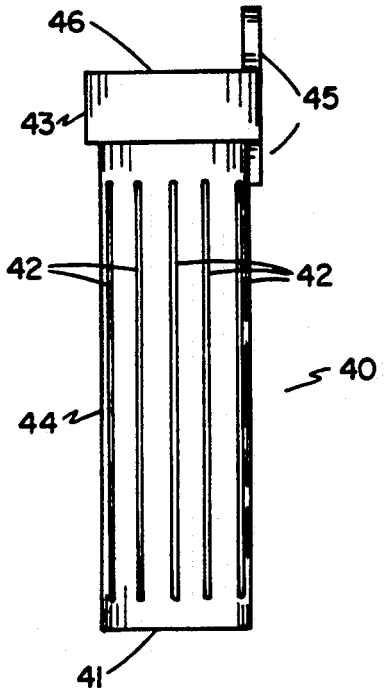
FIG. 3B is a side view of the Unit B or Unit C main shaft filter unit.

The sprinkle head assembly 20 includes a main shaft 30, spring 47, outer cap 21, filter 40, and nozzle assembly 50. As may be most clearly seen from FIG. 1C and FIG. 2A, the outer cap 21 is provided with a central passage or opening 23 and a sleeve 24 surrounding said opening 23. The cap 21 has a downwardly protruding radial element 25 in parallel with the sleeve 24. The element 25 has internal threads 22 which are adapted to matingly engage the external threads 12 formed on the base mount 10 near the base mount upper end 11 so that the outer cap 21 may be removably connected to the upper end 11 of the base mount 10. The sprinkle head assembly's main shaft 30 is adapted to slide through the outer cap central opening 23 between the sprinkle head assembly's retracted and extended positions. The outer cap 21 also contains a seal 28 positioned in a radial groove 29 about the cap's central opening 23. The seal 28 prevents dirt and grime from entering the cap central opening 23 along the main shaft 30, thereby preventing "jamming" between the outer cap 21 and the main shaft 30. The seal 28 also prevents water from escaping between the main shaft 30 and outer cap 21 during sprinkler operations. The sprinkler units A, B and C are installed in the sprinkler system so that the outer cap top 27 is approximately level with the ground 3.

Figure 4B:
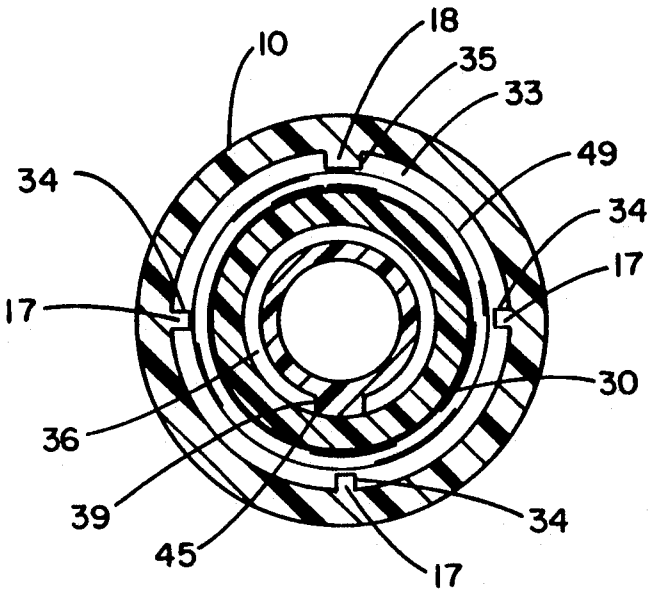
FIG. 4B is a sectional view along the line 4A—4A of FIG. 1A for a Unit B or Unit C sprinkler unit.
Figure 4A:
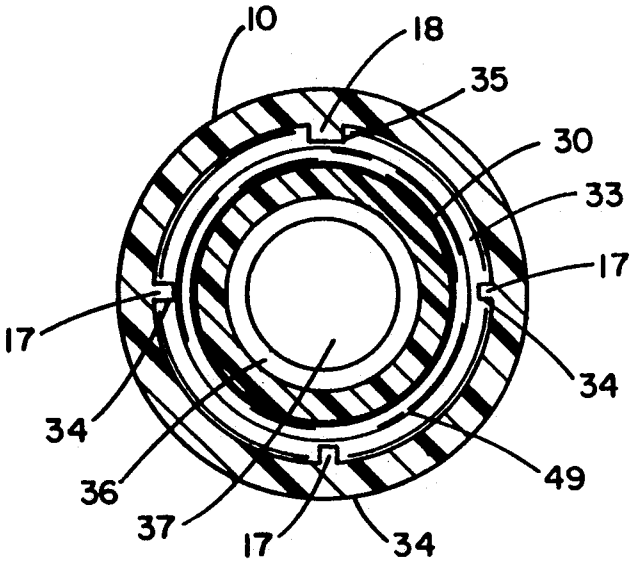
FIG. 4A is a sectional view along the line 4A—4A of FIG. 1A for a Unit A sprinkler unit.
Figure 5B:
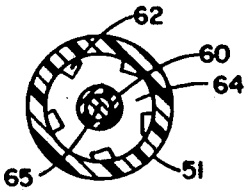
FIG. 5B is a sectional view along the line 5B—5B of FIG. 5A.
Figure 5A:
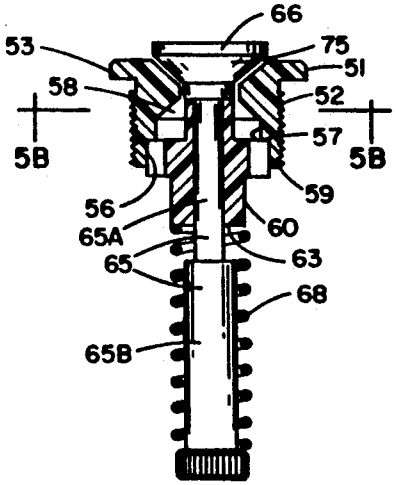
FIG. 5A is a longitudinal side sectional view of the Unit A nozzle assembly.

The sprinkle head assembly main shaft 30 is a hollow, longitudinally extending cylinder for the passage of water there-through, received from inlet 14. The main shaft 30 may be formed from any suitable material and is preferably molded from a suitable plastic material. The shaft 30 is mounted in the base mount 10 so that the shaft's upper end 31 extends through the outer cap central passageway 23 and out of the base mount 10 when the sprinkle head assembly 20 is in its extended position. The main shaft's lower end 32 terminates in an outwardly extending radial flange 33. The outer diameter of the flange 33 is slightly less than the inner diameter of the base mount 10. The flange 33 has four equispaced notches, three 34 narrow and one 35 relatively wider (see FIGS. 4A and 4B). The notches 34 and 35 correspond to and cooperatively engage the internal base mount lands 17 and 18, respectively. This arrangement of notches 34, 35 and lands 17, 18 permits the main shaft 30 to be installed within the base mount 10 in only one position.

A coil spring 47 is provided to surround the main shaft 30. The spring bottom 48 rests on the main shaft flange 33. The spring top 49 engages the cap sleeve 24 formed about the cap's central opening 23. The spring 47 is compressed when the sprinkle head assembly 20 is actuated to its extended position. The spring 47 operates to bias or urge the sprinkle head assembly 20 back from the extended position to the retracted position when water pressure is discontinued.

The mainshaft 30 contains within it an elongated, generally cylindrical, filter element 40. The filter 40 has an upper portion 43, lower portion 44, and a closed bottom 41. Ten narrow longitudinal slots 42 are provided along most of the lower portion's 44 length. The upper portion 43 of the filter 40 is unslotted and has a wider diameter than the slotted lower portion 44. The main shaft 30 has an internal radial flange 36 with a central opening 37. The diameter of the said opening 37 is greater than the diameter of the filter's lower portions 44 but less than the diameter of the filter upper portion 43. The filter's upper portion 43 rests on the flange 36 with the filter's slotted lower portion 44 extending downwardly through the flange opening 37 toward the lower end 32 of the main shaft 30.

The nozzle assembly 50 is made up of an inner cap 51, orifice unit 60, spray head 66, spray head shaft 65 and spring 68. The nozzle assembly 50 engages the main shaft 30 by means of external threads 52 on the inner cap 51 which cooperatively engage internal threads 38 in the main shaft's upper end 31. The inner cap 51 has a radial flange 53 above its external threads 52. When the nozzle assembly 50 and main shaft 30 are fully engaged, the inner cap's radial flange 53 is seated in a radial groove 26 positioned in the outer cap top 27 about the outer cap's central opening 23.

The inner cap 51 has a central opening 54 along its longitudinal axis. The cap's top center portion 55 is beveled downwardly to the central opening 54. A first radial groove 56 is formed around the central opening 54 at the bottom central portion 59 of the cap 51. A second radial groove 57 is formed about the central opening 54 just above the first radial groove 56. The diameter of the second radial groove 57 is less than the diameter of the first radial groove 56. The second radial groove 57 is then beveled radially inwardly and upwardly along the central opening 54.

The orifice unit 60 has a cylindrical shape with a central opening 61 and a central, external radial flange 64 with five angled grooves 62 about its radial circumference adapted to import a swirling effect on water as it passes through the grooves 62. The orifice unit flange 64 fits snugly into the inner cap's first radial groove 56. The chamber 58 formed by the inner cap's second radial beveled groove 57 has an atomizing effect on the water as it leaves the orifice grooves 62.

A spray head shaft 65 extends through the central openings 61 and 54 of the orifice unit 60 and the inner cap 51, respectively. The top of the spray head shaft 65 terminates in a spray head 66 which has an inverted conical shape, the upwardly flaring surface 75 cooperating with the top central portion 55 of the inner cap 51 to distribute a fine water spray therebetween in an inverted conical shape. The spray head 66 is adapted to partially seat within the corresponding portion of the inner cap top center portion 55 when the nozzle assembly 50 is in a fully retracted position. The bottom of the spray head shaft 65 terminates in a retaining flange 67. A small coil spring 68 surrounds the spray head shaft 65. The spring bottom 69 rests on the retaining flange 67. The spring top 70 abuts the bottom 63 of the orifice unit 60. For ease of assembly and disassembly the spray head shaft 65 may come in two parts, 65A and 65B, interconnected by conventional means such as screw threads, etc. When unit A is fully assembled, the orifice central flange 64 rests on the filter top 46.

Units B and C are identical to unit A except in two aspects. The main shaft radial flange 36 in units B and C has a notch 39. This corresponds to an element 45 which downwardly protrudes from the filter's upper portion 43. Only by sliding the filter element 45 through the notch 39 will the filter 40 be properly seated within the main shaft 30. The element 45 also has a portion which protrudes above the filter top 46.

Figure 7C:
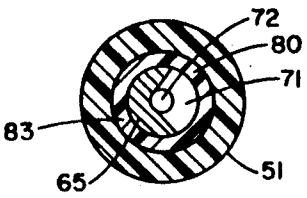
FIG. 7C is a sectional view along the line 7C—7C of FIG. 7A.
Figure 7B:
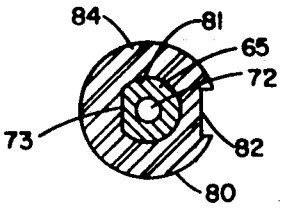
FIG. 7B is a sectional view along the line 7B—7B of FIG. 7A.
Figure 7A:
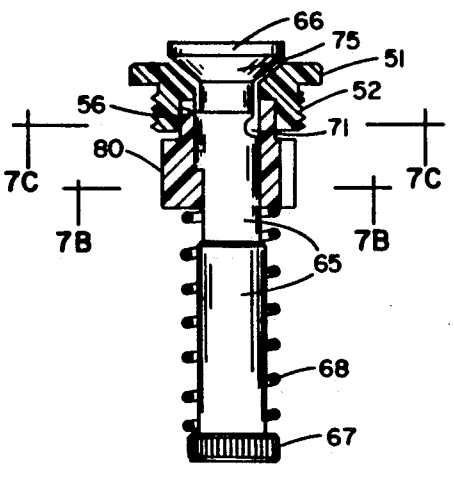
FIG. 7A is a longitudinal side sectional view of the Unit C nozzle assembly.
Figure 6C:
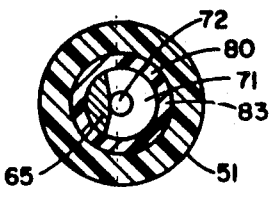
FIG. 6C is a sectional view along the line 6C—6C of FIG. 6A.
Figure 6B:
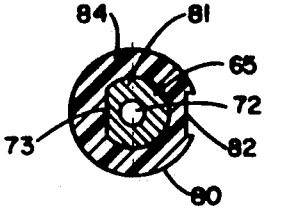
FIG. 6B is a sectional view along the line 6B—6B of FIG. 6A.
Figure 6A:
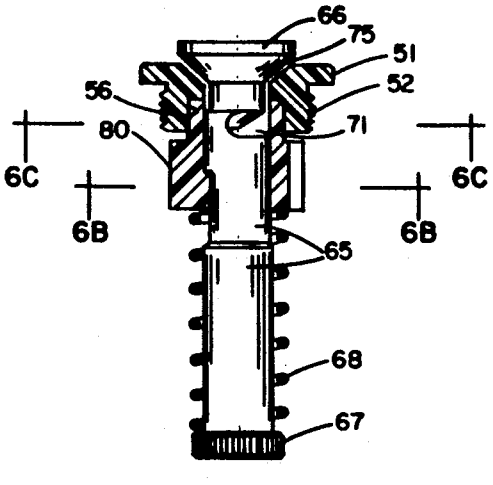
FIG. 6A is a longitudinal side sectional view of the Unit B nozzle assembly.

The nozzle assemblies 50 of both units B and C are also different from unit A. In units B and C, the spray head shaft 65 is hollow. A spray control chamber 71 is formed in the shaft 65 below the spray head 66. The chamber 71 is either shaped for a 90 degree spray (unit C, FIG. 7A) or a 180 degree spray (unit B, FIG. 6A), and internally opens to the hollow space 72 within the shaft 65. Water flows through the hollow shaft space 72, into and out of the spray control chamber 71, against the upwardly flaring shape 75 of the spray head 66, and out of the sprinkle unit 1 in either a 90 degree or 180 degree arc. The inner cap 51 is different in that it does not have the beveled flange 57 of Unit A. Also, the orifice unit 60 of Unit A is replaced with a position adaptor 80. The position adapter 80 has an upper 83 and a lower 84 radial portion. The diameter of the upper portion 83 is less than the diameter of the lower portion 84. The position adaptor 80 slides onto the shaft 65 and its upper portion 83 fits into the inner cap radial groove 56. However, that portion of the shaft 65 around which the adaptor 80 is positioned has an arc section cut away resulting in a flattening of one side of that portion 73 of the shaft. The central opening 81 of the position adaptor 80 is shaped to correspond with the shaped portion 73 of the shaft 65. The adaptor 80, therefore, may only fit over the shaft 65 in one radial position. The adaptor 80 has a longitudinal groove 82 on one external side of its lower portion 84. The filter element portion 45 protruding above the filter top 46 engages the groove 82 when unit B or C is assembled. By this means the direction of the spray for Units B and C is preset.

A plug 5 is also provided. When the nozzle assembly 50 is removed for cleaning, the spring 47 would normally force the outer cap 21 off of the main shaft 30. The plug 5 solves this problem. The plug 5 is similar to the inner cap 51 in shape but has no central opening 54. When the nozzle assembly 50 is removed from one of the units A, B, or C, the plug 5 is screwed into the main shaft 30 thereby sealing the upper portion 31 of the main shaft 30 and holding the outer cap 21 in place.

Units A, B and C each spray with an arc of 360, 180 and 90 degrees respectively with a radius capability of eighteen feet. Unit A generates its spray by water line pressure which forces the water to interact with surfaces in the main shaft 30, filter 40, five orifice grooves 62, inner cap 51 and spray head 66 when main shaft 30 and spray head 66 have been outwardly extended to a distance of 3.50 and 0.25 inches respectively. Units B and C generate their sprays also by water line pressure which forces the water to interact with surfaces in main shaft 30, filter 40, hollow shaft 65, spray control chamber 71, and spray head 66 when main shaft 30 and spray head 66 have been outwardly extended likewise to a distance of 3.50 and 0.25 inches respectively. The parts in the instant invention are designed to close tolerances to provide finer spray for reduced water consumption and to reduce spaces between cooperating surfaces in the mainshaft assembly 30 and outer cap 21, and cooperating surfaces between the spray head shaft 65 and orifice unit 60, and spray head shaft 65 and position adapter 80 in Units B and C. Such parts would otherwise entrap sand, dirt and/or provide a recess for insects and related debris thereby causing spray passageways to become clogged, either partially or fully. In the retracted or closed position, the main shaft 30 is enclosed within the base mount 10 and the spray head 66 is partially enclosed within the inner cap 51 to reduce exposure to damage and prevent loading with sand, dirt and/or insects and related debris which could close, distort or reduce spray area.

As stated above, the spray head 66 and main shaft 30 normally rest in the retracted or closed position within the inner cap 51 and within base mount 10 to reduce exposure to damage or becoming loaded with dirt or other contaminants which could clog sprinkler head assemblies 20 thereby distorting or reducing the spray pattern. The base mount 10 is installed in a vertical position to the ground 3, and the sprinkler system 1 operates by water pressure entering the base mount 10 causing the spring 47 and spray head shaft spring 68 milliseconds later to compress thereby forcing the main shaft 30 and spray head 66 to extend upwardly to their optimal spraying positions. The water passing through filter 40 enters the nozzle assembly 50 free of contaminant. When water ceases to enter the base mount 10, such lack of water pressure causes the springs 68 and 47 milliseconds later to reextend thereby forcing the spray head 66 and main shaft 30 to return to their retracted or closed positions.

The sprinkler head assembly 20 and/or nozzle assembly 50, separately, are manually removeable from the base mount 10 and from the main shaft 30 respectively thereby making the filter 40 accessible for removal for cleaning. Following cleaning, the filter 40 and nozzle assembly 50 are reinstalled in sequence in their original orientation in main shaft 30 with the filter 40 serving as a key to interface with the notch 39 in main shaft 30 and with groove 82 in the position adaptor 80 in units B and C. The sprinkler head assemblies 20 are reinstalled in their original orientation within the base mount 10 by the cooperative engagement of the main shaft notches 34 and 35 with the base mount lands 17 and 18 respectively. This cylindrical feature insures that the sprinkler head assemblies 20 can only be reassembled by returning it to its original orientation in the base mount 10 such that the spray pattern need never be reset. Other sprinkler devices must be reset after each cleaning and each time a sprinkler device is reset, the operator often gets wet with the spray.

The invention operates at high or low water pressure. Units A, B and C have a minimum of dissimilar parts for a plurality of arc settings for spraying water uniformly and efficiently on lawns/landscape of varying configurations wherein the number of sprinkler heads and amount of water used in minimized. The main shaft 30 and nozzle assembly 50 are easily removed by hand from the base mount 10 and from the main shaft 30 respectively. After removing the sprinkler head assembly 20 from the base mount 10 and removing the nozzle assembly 50 from the main shaft 30 is completed, the plug 5 is then installed in the main shaft 30 to prevent the disengagement of the outer cap 21 from the main shaft 30. The filter 40 is then accessible for removal and cleaning.

It is understood that the above-described embodiment is merely illustrative of the application. Other embodiments may be readily devised by those skilled in the art which will embody the principles of the invention and fall within the spirit and scope thereof.

I claim:

1. A sprinkler unit with a preset spray pattern for use in an underground sprinkler system, comprising:

a base mount having a substantially vertical cylindrical shape and internally formed into a cylindrical well having a plurality of longitudinal lands and having an open top end and a bottom end with an inlet for receiving water under pressure; and a sprinkler head assembly positioned in said base mount through said base mount's top end for vertical movement relative to said base mount and in response to said water pressure, wherein the sprinkler head assembly is comprised of:

a hollow, generally cylindrical main shaft with a top end and a bottom end concentrically positioned within said base mount and having an internal radial flange with a central opening, wherein said main shaft bottom end terminates in an outwardly extending radial flange with a plurality of notches corresponding to and cooperatively engaging the internal base mount lands, whereby said main shaft may be installed within said base mount in only one position;

an outer cap with a central opening radially positioned about said main shaft and removably attached to said base mount, wherein said central opening contains a radial groove into which a resilient O-ring seal is positioned thereby preventing dirt and grime from entering and water from escaping between the main shaft and outer cap;

a spring, having a top and a bottom, positioned about said main shaft and inside said base mount, wherein said spring bottom rests on said main shaft base mount bottom flange and said spring top abuts against said outer cap, and normally acts to retract said sprinkler head assembly with a force smaller that exertible by said water pressure;

an elongated, generally cylindrical filter concentrically positioned within said main shaft and having an upper portion, lower portion, and closed bottom, said upper portion having a diameter greater than the diameter of the main shaft internal flange central opening and said lower portion having a diameter less than the diameter of the main shaft internal flange central opening, and said lower portion having a plurality of narrow longitudinal slots along most of its length; and a nozzle assembly removably attached to said main shaft comprised of:

an inner cap with a central opening removably attached to said main shaft;

a spray head shaft with two ends, one end of which terminates in a spray head and the other end of which terminates in a radial flange, wherein said spray head shaft is vertically and longitudinally positioned concentrically through said inner cap central opening for vertical movement relative to said inner cap in response to said water pressure;

an orifice unit concetrically positioned about said spray head shaft and abutting said inner cap; and a spring with two ends positioned about said spray head, one end of which rests on said radial flange and the other end of which abuts against said orifice unit, and normally acting to retract said spray head shaft into said inner cap with a force smaller that exertible by said water pressure.

2. A sprinkler unit in accordance with claim 1 wherein:

said outer cap has a sleeve surrounding said central opening and a downwardly protruding radial element in parallel with the sleeve, said element having internal threads which are adapted to mating engage external threads formed on the base mount near the base mount upper end.

3. A sprinkler unit in accordance with claim 2 further comprising:

a plug removably attached to said main shaft when said nozzle assembly is removed for cleaning.

4. A sprinkler unit with a preset spray pattern for use in an underground sprinkler system, comprising:

a base mount having a substantially vertical cylindrical shape and internally formed into a cylindrical well having a plurality of longitudinal lands and having an open top end and a bottom end with an inlet for receiving water under pressure; and a sprinkler head assembly positioned in said base mount through said base mount's top end for vertical movement relative to said base mount and in response to said water pressure, wherein the sprinkler head assembly is comprised of:

a hollow, generally cylindrical main shaft with a top end and a bottom end concentrically positioned within said base mount and having an internal notched radial flange with a central opening, wherein said main shaft bottom end terminates in an outwardly extending radial flange with a plurality of notches corresponding to and cooperatively engaging the internal base mount lands, whereby said main shaft may be installed within said base mount in only one position;

an outer cap with a central opening radially positioned about said main shaft and removably attached to said base mount, wherein said central opening contains a radial groove into which a resilient O-ring seal is positioned thereby preventing dirt and grime from entering and water from escaping between the main shaft and outer cap; a spring, having a top and a bottom, positioned about said main shaft and inside said base mount, wherein said spring bottom rests on said main shaft base mount bottom flange and said spring top abuts against said outer cap, and normally acts to retract said sprinkler head assembly with a force smaller that exertible by said water pressure;

an elongated, generally cylindrical filter concentrically positioned within said main shaft and having an upper portion with a tab which fits into the notch of the main shaft's internal radial flange, lower portion, and closed bottom, said upper portion having a diameter greater than the diameter of the main shaft internal flange central opening and said lower portion having a diameter less than the diameter of the main shaft internal flange central opening, and said lower portion having a plurality of narrow longitudinal slots along most of its length; and a nozzle assembly removably attached to said main shaft comprised of:

an inner cap with a central opening removably attached to said main shaft;

a hollow spray head shaft with a flattened side and two ends, one end of which terminates in a spray head and the other end of which terminates in a radial flange, wherein said spray head shaft is vertically and longitudinally positioned concentrically through said inner cap central opening for vertical movement relative to said inner cap in response to said water pressure;

a spray control chamber formed into said hollow spray head shaft below said spray head;

a position adaptor with a central opening concentrically positioned about said spray head shaft and abutting said inner cap wherein said central opening's contour matches the contour of said spray head shaft; and a spring with two ends positioned about said spray head shaft, one end of which rests on said radial flange and the other end of which abuts against said position adaptor, and normally acting to retract said spray head shaft into said inner cap with a force smaller that exertible by said water pressure.

5. A sprinkler unit in accordance with claim 1 wherein:

said outer cap has a sleeve surrounding said central opening and a downwardly protruding radial element in parallel with the sleeve, said element having internal threads which are adapted to mating engage external threads formed on the base mount near the base mount upper end.

6. A sprinkler unit in accordance with claim 2 further comprising:

a plug removably attached to said main shaft when said nozzle assembly is removed for cleaning.

* * * * *